US007874320B2

(12) United States Patent
Knapp et al.

(10) Patent No.: US 7,874,320 B2
(45) Date of Patent: Jan. 25, 2011

(54) METHOD OF PRODUCING A WOVEN ARTIFICIAL TURF

(75) Inventors: Timothy A. Knapp, St. Catharines (CA); Mark H. Nicholls, East Welland (CA); James A. Schinkel, St. Catharines (CA)

(73) Assignee: Shaw Contract Flooring Services, Inc., Dalton, GA (US)

( * ) Notice: Subject to any disclaimer, the term of this patent is extended or adjusted under 35 U.S.C. 154(b) by 0 days.

(21) Appl. No.: 12/649,224

(22) Filed: Dec. 29, 2009

(65) Prior Publication Data

US 2010/0101678 A1 Apr. 29, 2010

Related U.S. Application Data

(63) Continuation of application No. 11/401,144, filed on Apr. 10, 2006.

(51) Int. Cl.

| | |
|---|---|
| ***D03D 39/20*** | (2006.01) |
| ***D03D 27/12*** | (2006.01) |
| ***D03D 27/02*** | (2006.01) |
| *D03D 1/00* | (2006.01) |
| *D03D 25/00* | (2006.01) |

(52) U.S. Cl. ..... 139/21; 139/37; 139/383 R; 139/420 R; 139/420 A

(58) Field of Classification Search ..... 139/21, 139/37, 383 R, 116.5, 391, 392, 399–401, 139/404–406, 416–418, 420 R, 426 R, 420 A
See application file for complete search history.

(56) References Cited

U.S. PATENT DOCUMENTS 3,332,828 A * 7/1967 Faria et al. ..... 428/17
3,551,263 A * 12/1970 Carter et al. ..... 428/17
3,573,147 A * 3/1971 Elbert ..... 428/17
3,596,576 A * 8/1971 Cicero et al. ..... 404/32
3,597,297 A * 8/1971 Bucholtz ..... 428/17
3,617,413 A * 11/1971 Elbert ..... 156/61
3,696,183 A * 10/1972 Steel et al. ..... 264/164

(Continued)

FOREIGN PATENT DOCUMENTS

CA 2 285 639 A1 * 4/1998

(Continued)

OTHER PUBLICATIONS

International Search Report of a Related Application (WO 2007/116290 A1), dated Oct. 18, 2007.

(Continued)

*Primary Examiner*—Bobby H Muromoto, Jr.

(57) ABSTRACT

In one embodiment, there is a method which includes providing a plurality of warp yarns; providing a plurality of fill yarns; providing a plurality of pile yarns of a first type; providing a plurality of pile yarns of a second type; providing a plurality of dummy yards; weaving the plurality of pile yarns of the first type with the plurality warp yarns and the plurality of fill yarns for a first predetermined distance to form a backing; weaving the plurality of pile yarns of the first type with the plurality of dummy yarns to form a plurality of short hoops for a second predetermined distance; cutting the plurality of pile yarns of the first type to form a first plurality of upstanding ribbons representing grass to produce a synthetic field surface.

4 Claims, 5 Drawing Sheets

U.S. PATENT DOCUMENTS

| | | | | |
|---|---|---|---|---|
| 3,740,303 | A * | 6/1973 | Alderson | 428/17 |
| 3,837,980 | A * | 9/1974 | Nishimura | 428/17 |
| 3,940,522 | A * | 2/1976 | Wessells | 428/17 |
| 3,974,312 | A * | 8/1976 | Stevens et al. | 428/91 |
| 3,995,079 | A * | 11/1976 | Haas, Jr. | 428/17 |
| 4,337,283 | A * | 6/1982 | Haas, Jr. | 428/17 |
| 4,389,435 | A * | 6/1983 | Haas, Jr. | 428/17 |
| 4,617,208 | A * | 10/1986 | Cadenhead, Sr. | 428/17 |
| 5,887,416 | A * | 3/1999 | Shimono et al. | 57/236 |
| 6,057,023 | A * | 5/2000 | Shimono et al. | 428/92 |
| 6,372,310 | B2 | 4/2002 | de Vries | |
| 6,491,991 | B2 * | 12/2002 | Seaton | 428/17 |
| 6,672,749 | B2 * | 1/2004 | Nicholls et al. | 362/559 |
| 6,691,455 | B1 | 2/2004 | Bergevin | |
| 6,794,007 | B2 * | 9/2004 | Carr et al. | 428/87 |
| 6,877,932 | B2 * | 4/2005 | Prevost | 405/38 |
| 6,902,789 | B2 * | 6/2005 | Funasako et al. | 428/95 |
| 6,950,599 | B2 * | 9/2005 | Nicholls et al. | 385/147 |
| 7,166,340 | B1 * | 1/2007 | Clark | 428/17 |
| 7,189,445 | B2 * | 3/2007 | Knox | 428/87 |
| 7,399,514 | B2 * | 7/2008 | De Clerck | 428/92 |
| 2001/0033902 | A1 * | 10/2001 | Seaton | 428/15 |
| 2002/0039636 | A1 * | 4/2002 | Fink et al. | 428/85 |
| 2002/0132084 | A1 * | 9/2002 | Fink et al. | 428/85 |
| 2002/0146519 | A1 * | 10/2002 | Carr et al. | 428/17 |
| 2002/0159275 | A1 * | 10/2002 | Nicholls et al. | 362/559 |
| 2003/0039511 | A1 * | 2/2003 | Prevost | 405/36 |
| 2003/0092531 | A1 * | 5/2003 | Daluise | 482/1 |
| 2003/0099787 | A1 * | 5/2003 | Fink | 428/17 |
| 2003/0143907 | A1 * | 7/2003 | Funasako et al. | 442/43 |
| 2004/0141711 | A1 * | 7/2004 | Nicholls et al. | 385/147 |
| 2004/0209038 | A1 * | 10/2004 | Foxon | 428/86 |
| 2004/0234719 | A1 * | 11/2004 | Jones | 428/62 |
| 2004/0247822 | A1 * | 12/2004 | Foxon | 428/95 |
| 2005/0064112 | A1 * | 3/2005 | Nicholls et al. | 428/17 |
| 2005/0129906 | A1 * | 6/2005 | Knox | 428/95 |
| 2005/0158482 | A1 * | 7/2005 | Cook | 428/17 |
| 2006/0093783 | A1 * | 5/2006 | De Clerck | 428/92 |
| 2007/0101566 | A1 * | 5/2007 | Cook | 29/428 |
| 2007/0137017 | A1 * | 6/2007 | Knox | 29/428 |
| 2007/0237921 | A1 * | 10/2007 | Knapp et al. | 428/92 |
| 2008/0141516 | A1 * | 6/2008 | Julicher et al. | 29/419.1 |
| 2008/0145574 | A1 * | 6/2008 | Julicher et al. | 428/17 |
| 2009/0286017 | A1 * | 11/2009 | Horio et al. | 428/17 |
| 2009/0286018 | A1 * | 11/2009 | Horio et al. | 428/17 |

FOREIGN PATENT DOCUMENTS

| | | | |
|---|---|---|---|
| CA | 2285639 | | 6/1998 |
| WO | 2006/075241 | A1 | 7/2006 |
| WO | WO 2006/075241 | A1 * | 7/2006 |
| WO | 2006/091085 | A1 | 8/2006 |
| WO | WO 2006/091085 | A1 * | 8/2006 |

OTHER PUBLICATIONS

Office Action of Parent Application (U.S. Appl. No. 11/401,144), dated Mar. 25, 2009.

Juska, Cheryl Ann; Final Office Action issued for U.S. Appl. No. 11/401,144 on Jul. 22, 2010; United States Patent & Trademark Office, Alexandria, VA, US.

* cited by examiner

METHOD OF PRODUCING A WOVEN ARTIFICIAL TURF

CROSS REFERENCE TO RELATED APPLICATIONS

This application claims the benefit of the filing date and is a continuation of U.S. patent application Ser. No. 11/401,144, filed on Apr. 10, 2006, entitled "WOVEN ARTIFICIAL TURF," the disclosure of which is incorporated herein by reference for all purposes.

TECHNICAL FIELD

The present invention relates to artificial turf and, more particularly, to a woven artificial turf system.

BACKGROUND INFORMATION

Artificial turf sport fields are well-known in the prior art. They are generally used to replace natural grass surfaces and comprise rows of synthetic ribbons that extend vertically from a backing layer. The synthetic ribbons are designed to resemble grass and an infill layer of particulate material is often interspersed between the ribbons on the backing layer. In this arrangement, the synthetic ribbons are designed to extend a distance above the infill layer of particulate material. It is known in the prior art that the infill may comprise sand, rubber, a mixture of sand and rubber or other granulated particles such as TPE and epdm rubber. The infill of particulate material provides resiliency to the surface and helps keep the ribbons in an upright position.

Generally, the ribbons and backing of artificial turf known in the prior art is formed by tufting the ribbons through one or more layers of backing. The backing may comprise a single layer of material or multiple layers of material, and the individual layers may be either woven or nonwoven material.

The tufting is generally done using a conventional tufting machine, which is a giant sewing machine with hundreds of needles. Multiple ends of yarn are fed to a bank of heavy needles with a span of twelve to fifteen feet. The tufting process involves a previously constructed primary backing passing under the needles and anchoring each stitch. The ribbons are thereby stitched into the backing fabric, leaving loops which form the turf pile. The pile may be loop pile, or cut pile or a combination of cut and loop introduced simultaneously in the turf by pushing off certain loops from the hook before they are cut.

Once the ribbons are tufted in place through the primary backing, the backing is further coated on its back side with a urethane or latex coating, often referred to as a secondary backing, to help adhere the stitched ribbons to the backing member and to provide dimensional stability.

Artificial turf known in the prior art has a number of drawbacks. For example, the amount of force needed to pull a ribbon from the backing (tuft bind) for tufted artificial turf is sometimes lower than desired. Also, it is often difficult to program and manufacture tufted turf having different colors and designs as it requires manually changing the polyethylene, polypropylene or nylon pile being fed into the tufting machine and/or cutting design elements into the turf at installation. Accordingly, it would be beneficial to provide artificial turf which securely holds the ribbons in place and allows greater versatility in terms of the height and composition of the artificial turf ribbons as well as the color and design of the turf.

SUMMARY

With parenthetical reference to the corresponding parts, portions or surfaces of the disclosed embodiment, merely for the purposes of illustration and not by way of limitation, the present invention provides an improved artificial turf system (15) comprising a pile fabric having a plurality of backing yarns (18-19, 48-51) woven with at least one pile yarn (20-23) to form a backing layer (16) and a plurality of upstanding synthetic ribbons (24-31), representing blades of grass, extending upwardly from an upper surface (17) of the backing layer, an infill layer (38) of particulate material disposed interstitially between the upstanding ribbons and upon the backing layer, and the upstanding ribbons extending above an upper surface (39) of the infill layer and having a length (41) from the upper surface of the backing layer of greater than one inch. The particulate material may be selected from a group consisting of hard (43) and resilient (42) granules.

In another aspect, the invention provides a synthetic surface comprising a pile fabric having a plurality of backing yarns woven with a plurality of pile yarns to form a backing layer and a plurality of upstanding synthetic ribbons, representing blades of grass, extending upwardly from an upper surface of the backing layer, the plurality of ribbons comprising ribbons of a first type and ribbons of a second type.

The ribbons of the first type may have a first length (44) above the upper surface of the backing and the ribbons of the second type may have a second length (45) above the upper surface less than the first length.

The ribbons of the first type and the ribbons of the second type may be selected from a group consisting of multifilament ribbons (25, 26, 31), fibrillated ribbons (24, 28, 29), cut ribbons (24, 25, 26, 29), looped ribbons (28, 31), texturized ribbons (26, 31), non-texturized ribbons (24, 25, 28, 29), long pile ribbons (24, 25), and short pile ribbons (26, 28, 29, 31). The ribbons of the first type may comprise non-texturized, cut, long pile, multifilament ribbons (25) and the ribbons of the second type may comprise non-texturized, cut, short pile, multifilament ribbons (26). The ribbons of the first type may comprise non-texturized, cut, long pile, multifilament ribbons (25) and the ribbons of the second type may comprise non-texturized, looped, short pile, fibrillated ribbons (28). The ribbons of the first type may comprise non-texturized, cut, long pile, multifilament ribbons (25) and the ribbons of the second type may comprise non-texturized, cut, short pile, fibrillated ribbons (29). The ribbons of the first type may comprise non-texturized, cut, long pile, fibrillated ribbons (24) and the ribbons of the second type may comprise texturized, cut, short pile, multifilament ribbons (26). The ribbons of the first type may comprise non-texturized, cut, long pile, fibrillated ribbons (24) and the ribbons of the second type may comprise non-texturized, looped, short pile, fibrillated ribbons (28). The ribbons of the first type may comprise non-texturized, cut, long pile, fibrillated ribbons (24) and the ribbons of the second type may comprise non-texturized, cut, short pile, fibrillated ribbons (29). The ribbons of the first type may comprise non-texturized, cut, long pile, multifilament ribbons (25) and the ribbons of the second type may comprise texturized, looped, short pile, multifilament ribbons (31). The ribbons of the first type may comprise non-texturized, cut, long pile, fibrillated ribbons (24) and the ribbons of the second type may comprise texturized, looped, short pile, multifilament ribbons (31).

The ribbons of the first type and the ribbons of the second type may form a pattern and the pattern may be selected from a group consisting of line markings, end-zone markings, field markings, team markings and advertisements.

The surface may be an artificial turf playing field and the ribbons of the first type and the ribbons of the second type may be woven to provide a change in texture from a first portion of the playing field to a second portion of the playing field. The playing field may be a baseball field and the second portion of the playing field may be a warning track.

The surface may further comprises an infill layer of particulate material disposed interstitially between the upstanding ribbons and upon the backing layer and the upstanding ribbons may extending above an upper surface of the infill layer.

The pile yarns may comprise a pile yarn having a first color and a pile yarn having a second color and the ribbons of the first type may comprise the first color and the ribbons of the second type may comprise the second color.

The ribbons of the first type may have a first width and the ribbons of the second type may have a second width that is different from the first width.

In another aspect, the invention provides a synthetic surface comprising a pile fabric having a plurality of backing yarns woven with a plurality of pile yarns to form a backing layer and a plurality of upstanding synthetic ribbons, representing blades of grass, extending upwardly from an upper surface of the backing layer, the pile yarns comprising a first yarn of a first color and a second yarn of a second color, whereby the upstanding ribbons comprise a plurality of ribbons of the first color and a plurality of ribbons of the second color.

The surface may further comprise a pile yarn of a third color, whereby the upstanding ribbons comprise a plurality of ribbons of the third color. The surface may be a playing field and the first color may be a general background color and the second and third colors may form a pattern in the playing field, and the pattern may be selected from a group consisting of line markings, end-zone markings, field markings, team markings, and advertisements. The plurality of pile yarns may comprise between four and sixteen yarns and each of the yarns may have a different color. The first and said second colors may be different shades of green.

Accordingly, the general object of the present invention is to provide a woven infilled artificial turf system.

Another object is to provide an artificial turf system in which the ribbons are held securely to the primary backing layer.

Another object is to provide an artificial turf system in which the upstanding ribbons may be formed of various types of synthetic material.

Another object is to provide an artificial turf system in which the upstanding ribbons have varying lengths.

Another object is to provide an artificial turf system in which the upstanding ribbons may be texturized, cut, looped, short pile, long pile, fibrillated or multifilament.

Another object is to provide an artificial turf system having a pattern woven into the artificial turf playing surface.

Another object is to provide an artificial turf system in which the pattern is integral to the artificial turf playing surface.

Another object is to provide an artificial turf system having line markings, end zone markings, field markings, team markings and advertisements woven into the artificial turf playing surface.

Another object is to provide an artificial turf system having different textures from one area to another woven into the artificial turf playing surface.

Another object is to provide an artificial turf system having different colored patterns woven into the artificial turf playing surface.

Another object is to provide an artificial turf system having ribbons of different widths woven into the artificial turf playing surface.

These and other objects and advantages will become apparent from the foregoing and ongoing written specification, the drawings and the appended claims.

DETAILED DESCRIPTION

Figure 1:
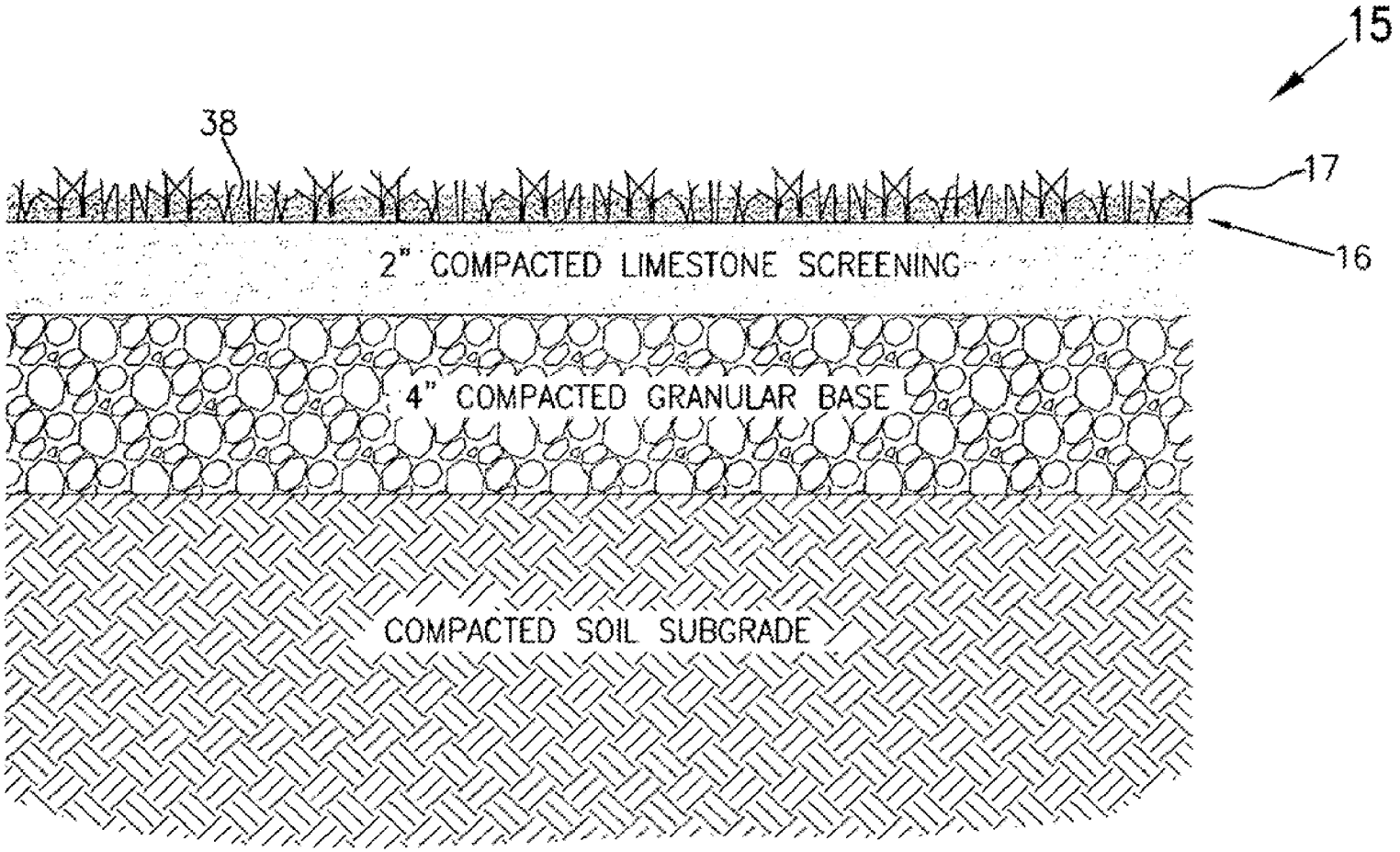
FIG. 1 is a cross-section view of the improved artificial turf system.

At the outset, it should be clearly understood that like reference numerals are intended to identify the same structural elements, portions or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, and more particularly, to FIG. 1 thereof, this invention provides an improved woven artificial turf system, the presently preferred embodiment of which is generally indicated at 15.

Figure 2:
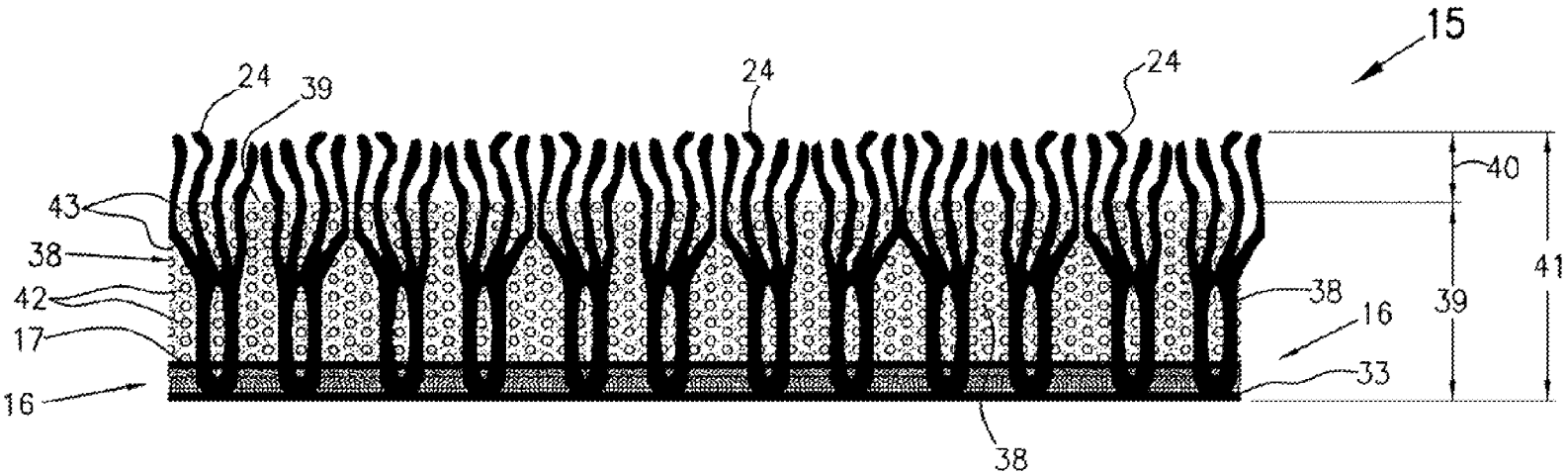
FIG. 2 is a partial enlarged cross-sectional view of a first embodiment of the woven artificial turf system.

FIG. 2 shows a first embodiment of the woven artificial turf system. As shown, in this embodiment the turf includes a primary backing layer 16 and a plurality of upstanding synthetic ribbons 24, representing blades of grass, extending upwardly from the upper surface 17 of backing layer 16. In this embodiment, ribbons 24 are fibrillated or slit-film extruded polyethylene ribbons. Fibrillation means that the yarn is of a flat, tape-like character and includes longitudinally extending slits across its width. With light brushing, these slits tend to split along the slits into several individual free standing strands of a width that is thinner then the full width of the yarn and thereby more closely resembles blades of grass. The Slit film-LSR yarn manufactured by Thiolon of Dayton, Tenn. may be used in the preferred embodiment.

As shown, an infill layer 38 is provided on the top surface 17 of backing layer 16. Infill layer 38 in this embodiment is a mixture of rubber 42 and sand 43 particles and is interspersed between the upstanding ribbons 24 on backing layer 16. As shown, synthetic ribbons 24 extend a length 41 of about one (1) inch or greater from the upper surface 17 of backing layer 16. The height 39 of infill 38 extends from ½ to ¾ of the height 41 of ribbons 24, which means that ribbons 24 extend a distance 40 of ½ to ⅓ of their height above the top surface 39 of infill 38.

Figure 11:
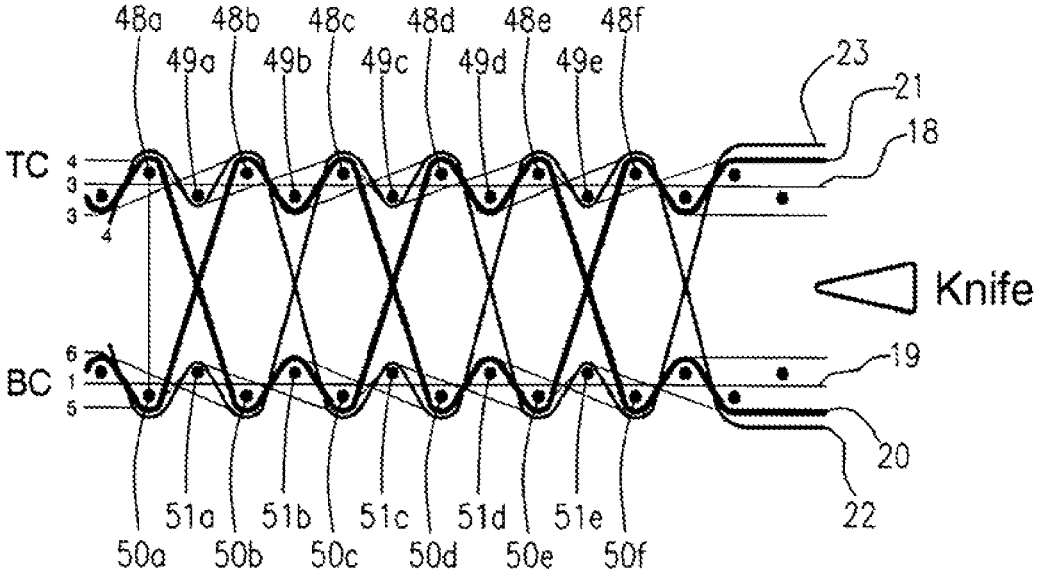
FIG. 11 is a partial cross-sectional view of the preferred weave structure or pattern design of the artificial turf system shown in FIG. 2.

As shown in FIG. 11, in the preferred embodiment turf 15 is woven on a weaving machine using a face to face weaving technique and a three yarn system, interlacing three yarns at right angles to each other. The length wide threads 18, 19 on the horizontal plane is the warp, the crosswise threads 48-51 on the horizontal plane is the fill or weft, and threads 20-24 woven in the vertical plane is the pile and are cut by knife 46 as indicated in FIG. 11. The warp and fill yarns form backing 16 and the pile yarns form ribbons 24-31. In the preferred embodiment, the artificial turf is a ⅜ W 4 frame woven pattern, as shown in FIG. 11, and pile yarns 20-24 are mainly in ⅜ W to have good pile fixation. The pile tuft has a W shape fixed over three fillings and is woven in rapport of eight picks. However, it is contemplated that other patterns or weave structures may be used. The SRX 82 weaving machine manufactured by Michel Van De Weile of Kortrijk, Belgium may be used in the preferred embodiment.

In this embodiment, each of pile strands 20-23 are the same fibrillated fibers, thereby forming a uniform type of ribbon 24 across the artificial turf surface. The upper and lower cams of the weave machine in FIG. 11 are separated by at least 2 inches such that the pile height 41 will extend at least 1 inch above the upper surface 17 of backing layer 16. The backing layer, as discussed above, is formed by the weaving of the warp strands 18 and 19 and the fill strands 48, 49 and 50, 51, respectively.

Figure 3:
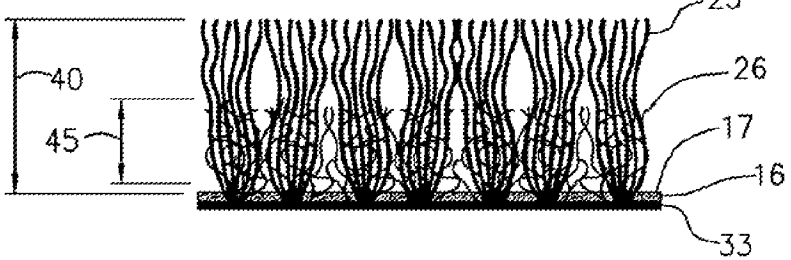
FIG. 3 is a partial enlarged cross-sectional view of a second embodiment of the woven artificial turf system.

FIG. 3 shows a second embodiment in which the vertically extending ribbons comprise two different types of ribbon material. In this embodiment, the ribbons include a first type of ribbon 25, which is non-texturized, cut, long pile, multifilament ribbon, and a second type of ribbon 26, which is texturized, cut, short pile, multifilament ribbon.

Multifilament ribbon is not fibrillated. The PE-Monofilament ribbon manufactured by Thiolon of Daton, Tenn. may be used in the this embodiment.

Textured yarns are yarns that develop a desired stretch and bulk on subsequent processing. When woven or knitted into fabric, the cover, hand, and other aesthetics of the finished fabric better resemble the properties of the fabric constructed from spun yarn. Texturing is the process of crimping, imparting random loops, or otherwise modifying continuous filament yarn to increase cover, resilience, abrasion resistance, warmth, insulation, and moisture absorption or to provide a different surface texture. Texturized methods can include a number of techniques. For example, one technique is an air-jet method were the yarn is led through a turbulent region of an air-jet at a rate faster than it is drawn off on the far side of the jet. A second example is the edge crimping method where thermal plastic yarns in a heated and stretched condition are drawn over a crimping edge and cooled. A third example is a false-twist method which utilizes simultaneous twisting, heat-setting and untwisting. The yarn is taken from the supply package and fed at controlled tension through the heating unit, through a false-twist spindle or over a friction surface that is typically a stack of rotating disks called an aggregate, through a set of take-up rolls, and onto a take-up package. The twist is set into the yarn by the action of the heater tube and subsequently is removed above the spindle or aggregate resulting in a group of filaments with the potential to form helical springs. A fourth example is a gear crimping method in which yarn is fed through the mesh teeth of two gears such that the yarn takes on the shape of the gear teeth. A fifth example is knit-de-knit method in which the yarn is knit into a two-inch diameter hoseleg, heat-set in an autoclave, and then unraveled and wound onto a final spool. This method produces a crinkle yarn. A sixth example is a stuffer box method in which a crimping unit consisting of two feed rolls and a brass tube stuffer box is provided. By compressing the yarn into the heated stuffer box, the individual filaments are caused to fold or bend at a sharp angle, while being simultaneously set by a heating device. Using conventional texturing methods, a number of different types of texturized yarns may be provided. For example, the textured yarn may be entangled yarn, knit-de-knit crinkle yarn, multi-filament coil yarn, monofilament coil yarn, stuffer box crinkle yarn and core-bulked yarn. A bulked yarn is a qualitative term used to described textured yarn and yarn that develops more bulk than stretch in the finished fabric. A coil yarn is a textured yarn that takes on a coil or spiral configuration when further processed. A core-bulked yarn is a bulky yarn composed of two sets of filaments, one of which is straight to give dimensional stability and forms a core around and through which the other set is coiled or looped to give bulk. A crinkle yarn is a torque-free textured yarn that is characterized by periodic wave configurations. An entangled yarn is a textured yarn that develops bulk by the air-jet texturing method. A modified stretch yarn is a yarn that develops more bulk than usual but less bulk than a bulked yarn in the finished fabric. The nylon texturized ribbon manufactured by Synthetic Turf Resources of Dalton, Ga. may be used in this embodiment.

Long pile and short pile refers to the relative height of the ribbon above surface 17 of backing 16. Long pile ribbons 25, the first type of ribbon, extend a distance 44 above the top surface 17 of backing layer 16. Short pile ribbons 26 extend a distance 45 above the top surface 17 of backing layer 16. Distance 44 is greater than distance 45, thereby providing a backing having both long pile and short pile ribbons. Providing dual piled ribbons 25 and 26 may be achieved in a number of ways. In this embodiment, the type of yarn used to form ribbons 26 is modified such that, when a secondary backing 33 of hot acrylic or urethane is applied to the underside of primary backing 16, the heat from the application of secondary backing 33 causes yarns 26 to wrinkle and shrink in length. Thus, the yarn employed to form ribbons 26 is heat sensitive and known to wrinkle with the application of heat. The nylon yarn manufactured by Synthetic Turf Resources of Dalton, Ga. may be used in the preferred embodiment. Accordingly, referring now to FIG. 11, strands 20 and 21 of the pile yarn is heat sensitive yarn while strands 22 and 23 is not as heat sensitive. Thus, after knife 46 is applied to cut the pile yarns, secondary backing 33 is applied and yarns 20 and 21 will shrink in length while yarns 22 and 23 will not shrink in length to the same extent with the application of such heat.

Alternatively, the weaving machine may be adjusted so that, as the machine runs, the yarn feeder allows for a predetermined length of yarn to be drawn with the needle. The predetermined amount can be varied for each needle and therefore each strand of yarn. Thus, strands 20 and 21 run through feeders shorter than the feeders for yarns 22 and 23. As a result, the pile height for yarns 20 and 21 after knife 46 is used are shorter than the pile height for yarns 22 and 23. This in turn provides a ribbon configuration with long pile ribbons intermingled with short pile ribbons.

As shown in FIG. 3, this embodiment does not include an infill layer. With this dual piled woven turf system an infill is not always necessary to provide resiliency. Instead, pile elements 25 and 26 are configured so as to provide appropriate cushioning and stability. In addition, a rubber undermat may be used with the system. However, it is contemplated that this embodiments may include an infill if desired. The infill may comprise hard particles such as sand, resilient particles such as rubber, or a combination of both hard and resilient particles.

Figure 4:
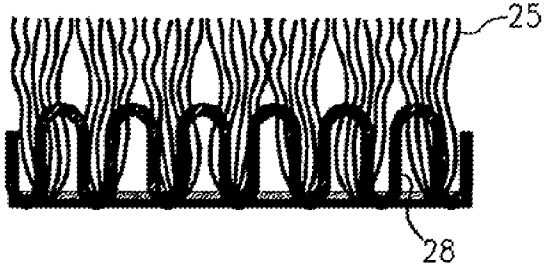
FIG. 4 is a partial enlarged cross-sectional view of a third embodiment of the woven artificial turf system.
Figure 12:
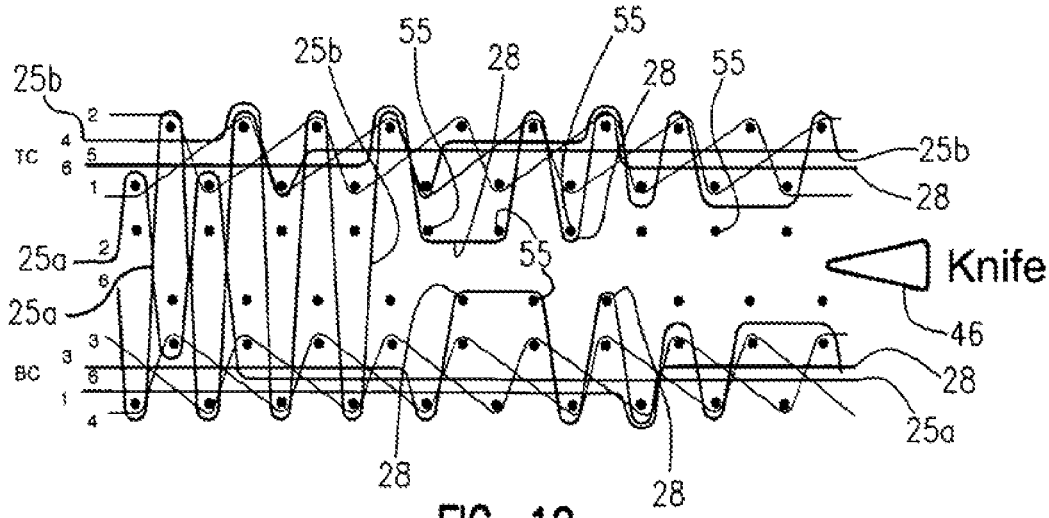
FIG. 12 is a partial cross-sectional view of the preferred weave structure or pattern design of the artificial turf system shown in FIG. 4.

FIG. 4 shows a third embodiment. This embodiment is similar to the second embodiment in that two different types of pile yarns are woven into the backing layer 16. Ribbons 25 are again non-texturized, cut, long pile, multifilament ribbons. Ribbons 28, however, are non-texturized, looped, short pile, fibrillated ribbons. As shown in FIG. 12, looped pile ribbons 28 are formed around a set of dummy fillings 55 that are supported by lancets which determine the pile height. After loop formation, the dummy yarns 55 are then pulled out or removed to leave the looped configuration. As shown, yarns 55 are positioned so that ribbons 28 do not extend between the upper and lower cams. Thus, knife 46 does not cut the formed loops, while knife 46 does cut the long pile yarns 25 that cross between the upper and lower cams.

As with the second embodiment, this embodiment does not have an infill layer. With this dual piled woven turf system, an infill is not necessarily needed to provide resiliency. Instead, pile elements 25 and 28 are configured so as to provide appropriate cushioning and stability. However, it is contemplated that this embodiments may include an infill if desired. The infill may comprise hard particles such as sand, resilient particles such as rubber, or a combination of both hard and resilient particles.

Figure 5:
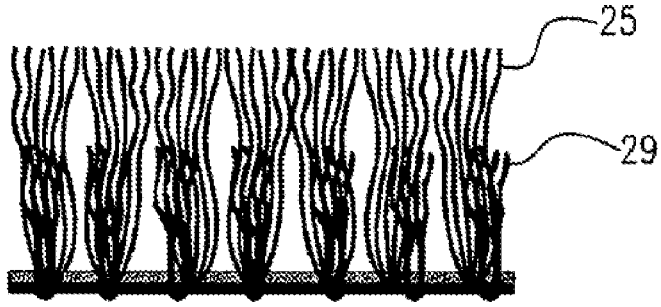
FIG. 5 is a partial enlarged cross-sectional view of a fourth embodiment of the woven artificial turf system.

FIG. 5 shows a fourth embodiment. This embodiment is similar to the embodiment shown in FIG. 3. However, in this embodiment, while long pile elements 25 are non-texturized, cut, long pile, multifilament ribbons, ribbons 29 are non-texturized, cut, short pile, fibrillated ribbons. Referring now to FIG. 11, ribbons 25 may be formed by weaving in as yarns 22 and 23 multifilament strands and weaving in as yarns 20 and 21 fibrillated strands. The pile height may be adjusted by either using a shrinking yarn type for pile elements 20 and 21 or by the mechanical adjustment of the weaving machine as discussed above with respect to the embodiment shown in FIG. 3. As with the embodiments shown in FIG. 3 and FIG. 4, this embodiment does not include an infill layer. However, it is contemplated that this embodiment may be used with an infill layer that extends some distance up the length of ribbons 25.

Figure 6:
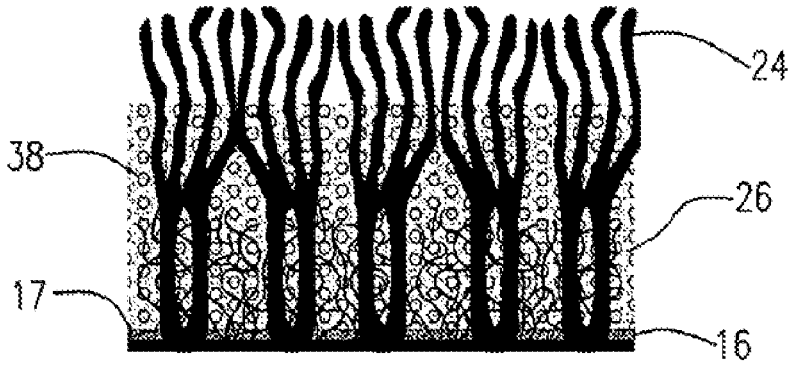
FIG. 6 is a partial enlarged cross-sectional view of a fifth embodiment of the woven artificial turf system.

FIG. 6 shows a fifth embodiment having long pile ribbons 24 that are non-texturized, cut, long pile and fibrillated. Ribbons 26 are of a second type that is texturized, cut, short pile and multifilament. Again, using the weave pattern shown in FIG. 11, long pile ribbons 24 are formed by weaving in as yarns 22 and 23 fibrillated strands, and ribbons 26 are formed by weaving in as yarns 20 and 21 texturized multifilament strands. Again, the pile height is adjusted by using a shrinking yarn as pile yarns 20 and 21 or by the mechanical adjustment of the machine as described above. Also, as shown in FIG. 6, this embodiment includes an infilled layer 38, which is a mixture of sand 43 and rubber 42 particles. As shown, the infill extends from top surface 17 of backing layer 16 to a height that is above the short pile ribbons 26 but slightly below the upper ends of long pile ribbons 24.

Figure 7:
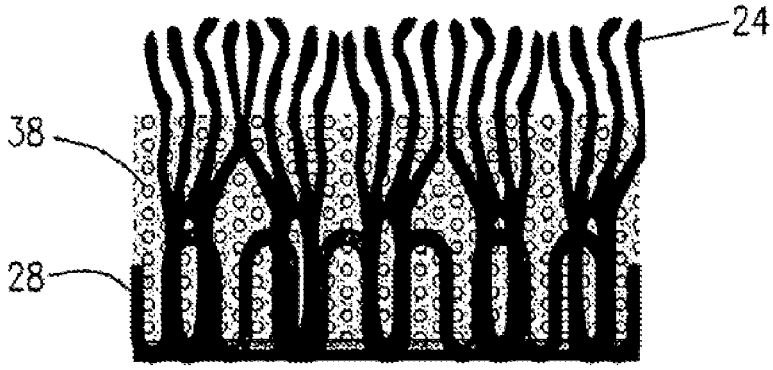
FIG. 7 is a partial enlarged cross-sectional view of a sixth embodiment of the woven artificial turf system.

FIG. 7 shows a sixth embodiment having a combination of non-texturized, cut, long pile, fibrillated ribbons 24 and non-texturized, looped, short pile, fibrillated ribbons 28. As shown in FIG. 12, the looped ribbons of this embodiment are formed similarly to the looped ribbons of the embodiment shown in FIG. 4, namely by forming loops 28 around a set of dummy fillings 55 that are pulled out after loop formation. Also, in this embodiment a sand and rubber mixed particle infill is interspersed between the pile elements to a height slightly below the height of the ends of long pile ribbons 24.

Figure 8:
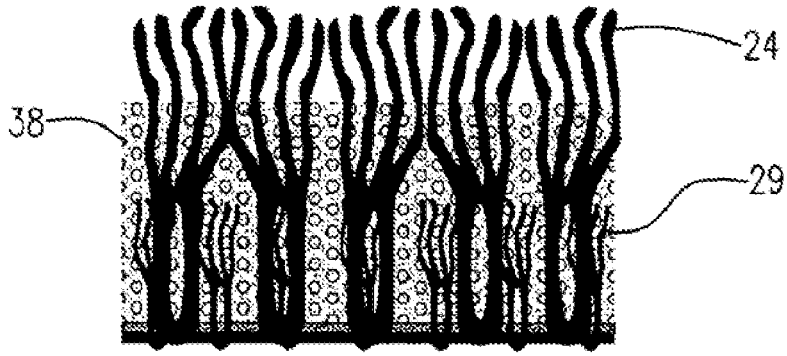
FIG. 8 is a partial enlarged cross-sectional view of a seventh embodiment of the woven artificial turf system.

FIG. 8 shows a seventh embodiment having a combination of non-texturized, cut, long pile, fibrillated ribbons 24 and non-texturized, cut, short pile, fibrillated ribbons 29. This embodiment may be woven pursuant to the weaving pattern shown in FIG. 11, with fibrillated yarn being woven through as pile elements 20 and 21 and fibrillated yarn being woven through as pile elements 22 and 23, with the pile height adjusted for pile elements 20 and 21 by either mechanical adjustment of the machine or by using a shrinking fibrillated yarn as described above. Again, the embodiment also includes a sand and rubber infill 38. While a sand and rubber infill is shown, it is contemplated with each of the embodiments that the infill may consist substantially of hard particles such as sand, resilient particles such as rubber, or some combination of resilient and hard granules. Alternatively, the embodiment may have no infill at all.

Figure 9:
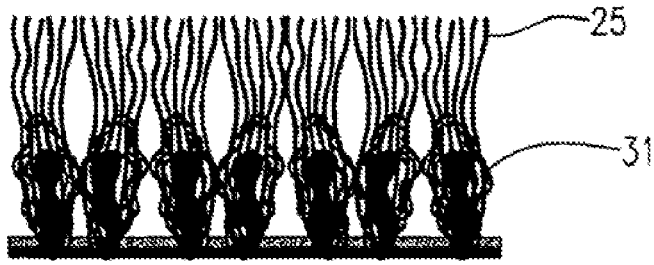
FIG. 9 is a partial enlarged cross-sectional view of an eight embodiment of the woven artificial turf system.

FIG. 9 shows an eighth embodiment having a combination of woven non-texturized, cut, long pile, multifilament ribbons 25 and texturized, looped, short pile, multifilament ribbons 31. This embodiment is woven using the looping technique shown in FIG. 12. Thus, looped ribbons 31 are formed similarly to the looped ribbons 28 of the embodiment shown in FIG. 4 by weaving the yarn around a set of dummy yarns 55 that are supported by lancets which determine the pile height. Again, after loop formation the dummy yarns 55 are removed. While this embodiment is shown without an infill layer, it is contemplated that it may include an infill.

Figure 10:
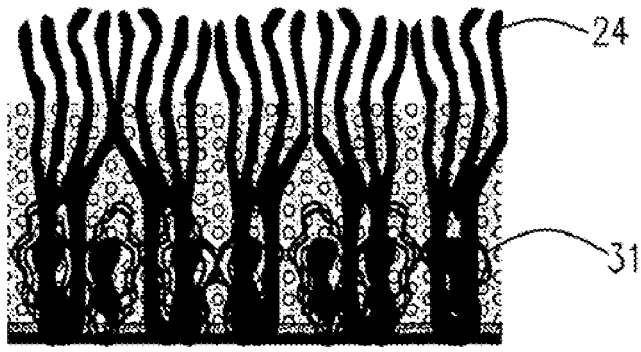
FIG. 10 is a partial enlarged cross-sectional view of a ninth embodiment of the woven artificial turf system.

FIG. 10 shows a ninth embodiment having a combination of non-texturized, cut, long pile, fibrillated ribbons 24 and texturized, looped, short pile, multifilament ribbons 31. Again, this weave may be formed using the weave structure shown in FIG. 12, with loops 31 formed around a set of dummy fillings 55 that are supported by lancets and are pulled out after loop formation.

Not only may the artificial turf system be formed with combinations of different types of ribbon interspersed amongst each other, but other characteristics of the ribbon may be varied. For example, the turf may be woven such that different patterns are used in different parts or areas of the turf. The patterns may be woven to provide line markings, end zone markings, field markings, team markings, advertisements, as well as other patterns. Furthermore, the artificial turf may be used to form a playing field and the texture of the playing field may vary from one area to the next. For example, a first portion of the playing field may have a first texture resulting from, for example, long pile, non-texturized fibrillated ribbons 24 and the second portion of the playing field may have a different texture due to a combination of pile elements in that portion of the field, such as both non-texturized, fibrillated ribbons 24 and texturized looped multifilament ribbons 31. The playing field could be a baseball field and one portion of the playing field could be a warning track such that a player running over the surface of the field would be able to tell that the texture of the field has changed due to the use of different combinations of woven ribbon in the first portion of the field as compared to a different combination of pile elements on the warning track of the field. This could provide substantial benefits as it would allow the player to use non-visual characteristics to determine when the player was nearing the outfield wall or other sensitive areas of the field.

Not only may the type of ribbon be varied, but also the width of the ribbons. This variation may be accomplished by using different width yarns in pile elements 20-23 and running each element as desired. For example, pile yarns 20-23 may be of varying widths such that the ribbons of pile yarn 20 are of a first width and the ribbons of pile yarn 21 are of a width different from the width of pile yarns 20. In addition, the color of the ribbon may vary by using different color pile elements in the weave. For example, pile yarns 21-23 may be of different colors. In this way, the ribbons formed from pile yarn 20 may be of different color then the ribbons formed from pile yarn 21, 22 or 23.

Thus, the artificial turf surface may be a playing field and the pile yarns 20 may be of a first color that is a general background color and pile yarns 20 and 22 may be of different colors that form a pattern in the playing field. The pattern may be line markings, end-zone markings, field markings, team markings, and advertisements. Thus, the patterns in the artificial turf might be easily adjusted by changing the colors of yarn elements 20-23 and adjusting when each pile yarn is woven into the backing yarns.

While FIG. 12 shows the use of dummy yarns 55 to form looped short pile, it also illustrates an alternative weave structure that varies the height of the pile across the surface from long to short and that also may use two different possible yarn types 25*a* and 25*b* to form the long pile elements.

Figure 13:
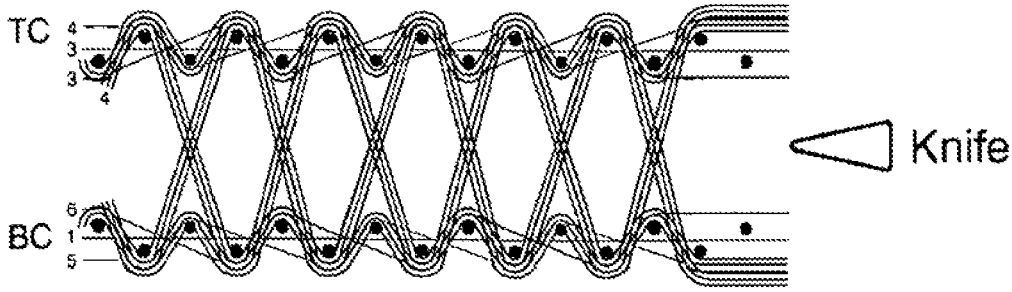
FIG. 13 shows an alternative weave structure.

FIG. 13 shows an alternative weave structure. In this weave structure, rather than employing two pile yarns into each section, four pile yarns are employed. This can be used to either increase the density of the ribbons of the artificial turf, or may be used to maintain the density of the pile elements but alternate between different colors, widths, or textures in different areas of the weave or turf. Also, this may be used to create long pile with multiple yarn types, with or without short pile elements.

Other alternative weave structure may be employed. For example, a weave structure may be used which employs up to six pile yarns that may be modified to form the desired density of pile with the desired ribbon type and color or pattern for the field. It is contemplated that between four and sixteen pile yarns may be employed of different colors, or of different types or widths. The larger the number of pile yarns, the wider the variety of types or characteristics of ribbons that can be woven while maintaining pile density.

Different weave structures may be employed to meet the desired functionality, pattern, texture or density of the artificial turf desired. Thus, using the inventive woven turf allows for the artificial turf sections to be provided with numerous varieties of combinations of ribbons. This allows for greater versatility and selection for the consumer of the artificial turf and saves time and cost as it allows for patterns to be woven into the turf rather than cut into the turf. Also, because a wide variety of different patterns and ribbons may be woven into the turf rather than needing to be cut into the turf, fewer seams in the playing surfaces are needed, which allows for a stronger and longer lasting playing surface.

The present invention contemplates that many changes and modifications may be made. Therefore, while the presently-preferred form of the woven artificial turf board as been shown and described, and several alternative embodiments and modifications thereof discussed, persons skilled in this art will readily appreciate that various additional changes and modifications may be made without departing from the spirit of the invention, as defined and differentiated by the following claims.

What is claimed is:

1. A method of producing a synthetic field surface, the method comprising:

providing a plurality of warp yarns;

providing a plurality of fill yarns;

providing a plurality of pile yarns of a first type;

providing a plurality of pile yarns of a second type;

providing a plurality of dummy yarns;

weaving the plurality of pile yarns of the first type with the plurality of warp yarns and the plurality of fill yarns for a first predetermined distance to form a backing;

weaving the plurality of pile yarns of the first type with the plurality of dummy yarns to form a first plurality of short hoops extending from the backing for a second predetermined distance;

weaving the plurality of pile yarns of the first type with the plurality of warp yarns and the plurality of fill yarns to form a first plurality of pile ribbons for a third predetermined distance;

weaving the plurality of pile yarns of a second type with the plurality of warp yarns and the plurality of fill yarns for a first predetermined distance to add to the backing;

weaving the plurality of pile yarns of the second type with the plurality of dummy yarns to form a second plurality of short hoops extending from the backing for a second predetermined distance;

weaving the plurality of pile yarns of the second type with the plurality of warp yarns and the plurality of fill yarns to form a second plurality of pile ribbons for a third predetermined distance;

cutting the plurality of pile yarns of the first type to form a first plurality of upstanding ribbons representing grass;

cutting the plurality of pile yarns of the second type to form a second plurality of upstanding ribbons representing grass;

wherein the pile yarns of a first type are of a first color and the pile yarns of a second type are of a second color and the weaving of the pile yarns of the first type and the pile yarns of the second type forms a predetermined pattern.

2. The method of claim 1, wherein the predetermined pattern is selected from a group consisting of line markings, end-zone markings, field markings, team markings, and advertisements.

3. The method of claim 1, wherein the first and said second colors are different shades of green.

4. The method of claim 1, further comprising applying heat to cause the second plurality of upstanding ribbons to shrink in length to differentiate the second plurality of upstanding ribbons from the first plurality of upstanding ribbons.

* * * * *